United States Patent [19]

Okazaki

[11] Patent Number: 4,965,541

[45] Date of Patent: Oct. 23, 1990

[54] WAVEGUIDE PROVIDED WITH DOUBLE DISK WINDOW ASSEMBLY HAVING DIELECTRIC DISKS

[75] Inventor: Yukio Okazaki, Ootawara, Japan

[73] Assignee: Kabushiki Kaisha Toshiba, Kawasaki, Japan

[21] Appl. No.: 355,570

[22] Filed: May 23, 1989

[30] Foreign Application Priority Data

May 23, 1988 [JP] Japan ..... 63-125129

[51] Int. Cl.[5] ..... H01P 1/08

[52] U.S. Cl. ..... 333/252; 315/5

[58] Field of Search ..... 333/252, 33, 251

[56] References Cited

U.S. PATENT DOCUMENTS

| | | | |
|---|---|---|---|
| 3,324,427 | 6/1967 | Weiss | 333/252 |
| 3,339,102 | 8/1967 | Johnson . | |
| 3,439,296 | 4/1969 | Buckley . | |
| 3,594,667 | 7/1971 | Mann . | |
| 3,860,891 | 1/1975 | Hiramatsu | 333/252 X |
| 4,286,240 | 8/1981 | Shively et al. | 333/252 |
| 4,371,854 | 2/1983 | Cohn et al. | 333/252 |
| 4,620,170 | 10/1986 | Lavering | 333/252 |
| 4,688,009 | 8/1987 | Ferguson et al. | 333/252 |

FOREIGN PATENT DOCUMENTS

| | | |
|---|---|---|
| 58-182349 | 12/1983 | Japan . |
| 623756 | 6/1949 | United Kingdom . |
| 669250 | 4/1952 | United Kingdom . |

OTHER PUBLICATIONS

IEEE Trans. on MTT, vol. MTT-33, No. 3, Mar. 1985, p. 274.

*Primary Examiner*—Paul Gensler

*Attorney, Agent, or Firm*—Cushman, Darby & Cushman

[57] ABSTRACT

In a double disk window assembly for a waveguide, first and second dielectric disks face each other and are coupled to waveguide segments, respectively. The second dielectric disk has a central coupling section which is mechanically coupled to the center region of the first dielectric disk. The first and second dielectric disks are sealed to define a gap through which a coolant passes.

11 Claims, 9 Drawing Sheets

WAVEGUIDE PROVIDED WITH DOUBLE DISK WINDOW ASSEMBLY HAVING DIELECTRIC DISKS

BACKGROUND OF THE INVENTION

1. Field of the Invention

The present invention relates to an improved waveguide provided with a double disk window assembly having microwave transmission dielectric disks.

2. Description of the Related Art

In some cases, a circular microwave transmission waveguide employs a microwave transmission window assembly at a predetermined position, so as to keep a high degree of vacuum in the waveguide. The microwave transmission window assembly comprises a pair of dielectric disks spaced from each other by a predetermined short distance, and a coolant is made to flow in the gap between the dielectric disks, for the cooling of the disk window assembly. If a waveguide employs a double faced disk cooled window assembly having such dielectric disks its passband is widened and its window cooling efficiency is increased, so that it becomes suitable for use in a microwave apparatus which is operated at a comparatively high operating frequency and requires a transmission line for high power. Such a waveguide is disclosed, for example in U.S. Pat. Nos. 3,110,000, 3,324,427, 4,286,240, 4,371,854 and 4,620,170, and also in Japanese Utility Model Disclosure No. 60-17002. A waveguide having the above microwave transmission window assembly is employed, for example in the output section of a microwave electron tube (such as a klystron, a traveling wave tube, and a gyrotron or the microwave transmission line of a particle accelerator.

To increase the operating frequency of a wave guide, the double faced disk cooled window assembly of that waveguide has to employ thin dielectric disks and the distance between the dielectric disks has to be shortened. Further, the flow rate of the coolant has to be increased in accordance with an increase in the microwave power passing through the waveguide. It should be noted, however, that great stress arising from the atmospheric pressure and the pressure of the coolant will be applied to the dielectic disks, if thin dielectric disks are employed, if the distance between the disks is shortened, or if the coolant-introducing pressure is increased for an increase of the flow rate of the coolant. As a result, it becomes likely that the dielectric disks will be broken, due to the great stress.

The maximum stress $\sigma$ max at the central point of a dielectric disk is expressed by the following formula:

$$\sigma \max = k \cdot P \cdot \frac{D^2}{t^2} \quad (1)$$

where k is a constant, P is the pressure difference between the two sides of a dielectric disk, D is the aperture of the dielectric disk, and the t is the thickness of the dielectric disk.

The thickness t of each dielectric disk is required to satisfy the following relation as a matching condition at an operating frequency:

$$t = n \cdot \frac{\lambda d}{2} \quad (2)$$

where $\lambda d$ is the wavelength within the dielectric disk, and n is an integer.

As may be understood from formula (2), it is necessary either to decrease the thickness of the dielectric disks or to increase the thickness by using a large value for the integer n. However, if the thickness of the dielectric disks is increased, the passband of microwaves will be narrowed. In addition, if the dielectric disks are forced of a material which does not conduct much heat in the thickness direction, the temperature difference between the two sides of each dielectric disk will increase. (One side of each disk is in contact with coolant, while the other is not.) As a result, the thermal stress will increase, with an increase in the thickness of the dielectric disks. Therefore, it becomes likely that the dielectric disks will be easily broken.

SUMMARY OF THE INVENTION

An object of the present invention is to provide a waveguide comprising a double disk window assembly, wherein thin dielectric disks are arranged with a comparatively narrow gap without adversely affecting the mechanical strength and the cooling capability, and which enables high-power driving at a high frequency.

The present invention provides a double disk window assembly which is used in a waveguide having first and second waveguide segments and is to be cooled with a waveguide coolant. To achieve the above object, the double window assembly comprises:

a first dielectric disk which permits a microwave to pass therethrough and is coupled air-tightly to the first waveguide segment; and a second dielectric disk which permits the microwave to pass therethrough, is located in a manner to face the first dielectric disk with a predetermined coolant-flowing gap maintained, is coupled air tightly to the second waveguide segment, and comprises a central coupling section for mechanically coupling the second dielectric disk to the first dielectric disk.

DETAILED DESCRIPTION OF THE PREFERRED EMBODIMENTS

Figure 1:
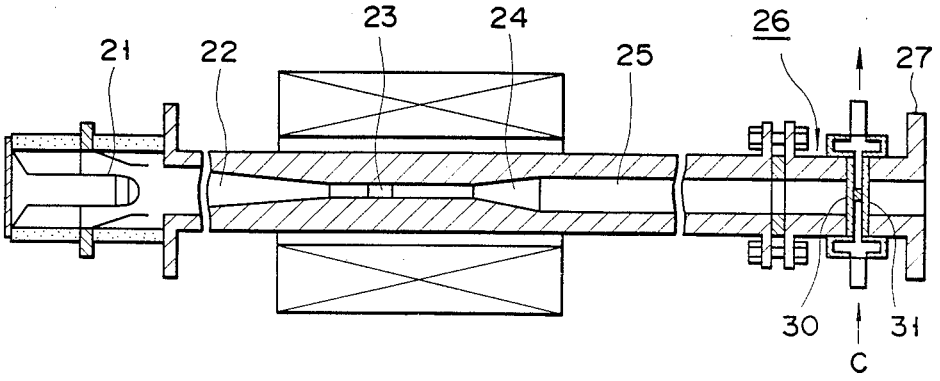
FIG. 1 is a schematic view of a gyrotron incorporating a waveguide according to one embodiment of the present invention.

An embodiment of the present invention will now be described, with reference to the accompanying drawings. FIG. 1 shows a gyrotron wherein a waveguide having a double disk window assembly according to one embodiment of the invention is incorporated. The gyrotron comprises electron gun section 21 for emitting hollow electron beams, and waveguide 26 located downstream of electron gun section 21 with reference to the electron beam-transmitting direction. Waveguide 26 includes: tapered electron beam introduction section 22 whose inner diameter gradually decreases in a direction away from electron gun section 21; resonance cavity 23; tapered microwave guide section 24 whose inner diameter gradually increases in the direction away from electron gun section 21; collector section 25 for collecting electron beams; and a double disk window assembly which transmits microwaves therethrough. The waveguide segment at the tip end of the gyrotron is coupled, by means of flange 27, to a waveguide segment of a certain apparatus (such as a plasma heating apparatus), the internal region of which waveguide segment is pressurized or maintained at the atmospheric pressure. The double disk window assembly includes a plurality of dielectric disks which are cooled by a coolant flowing in the direction indicated by arrow C in FIG. 1, the coolant having a characteristic of preventing attenuation of high-frequency microwaves.

Figure 2:
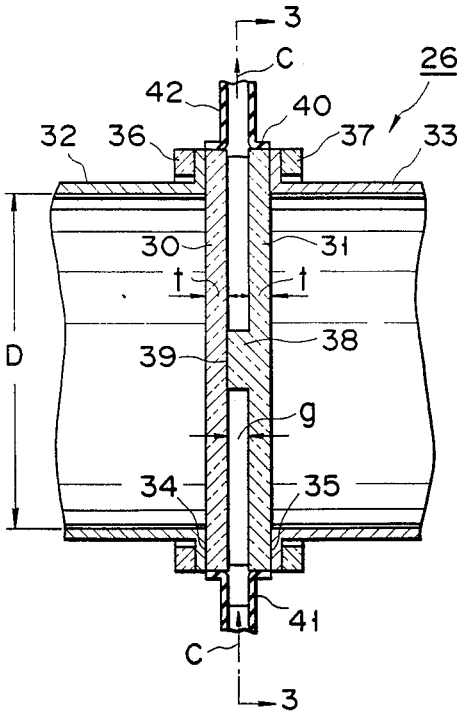
FIG. 2 is a longitudinal sectional view schematically showing the double disk window assembly employed in the gyrotron shown in FIG. 1.
Figure 3:
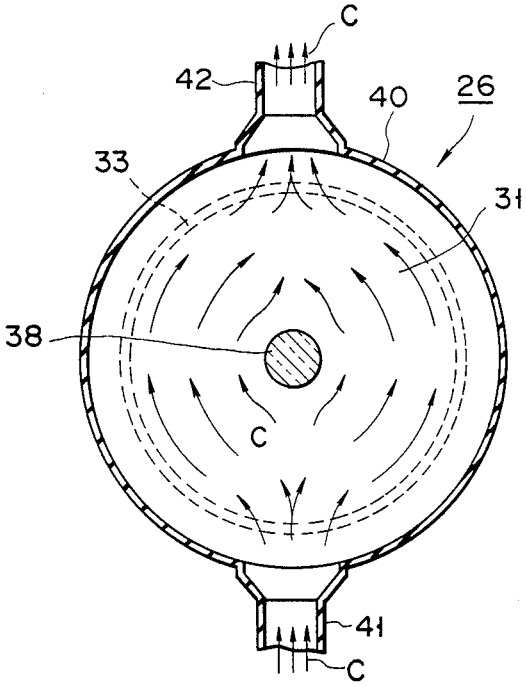
FIG. 3 is a sectional view taken along line 3—3 in FIG. 2.

In waveguide 26 shown in FIG. 1, a pair of disks 30 and 31, formed of a dielectric material which does not cause a large high-frequency loss and is exemplified by sapphire or ceramics (such as a alumina and beryllia), are air-tightly coupled to circular waveguide segments 32 and 33 at brazed portions 34 and 35, respectively, as is shown in FIGS. 2 and 3. One of the waveguide segments 32 is connected to the vacuum region of the main body of gyrotron, while the other waveguide segment 33 is connected to an external transmission waveguide segment, which is maintained at a pressurized state for the suppression of high-frequency discharge. For reinforcement, ceramic rings 36 and 37 are coupled to brazed portions 34 and 35, respectively. Out of the two dielectric disks, one dielectric disk 31 has small projection or spacing means 38 in the center of one side thereof. Small projection 38 is coupled to the other dielectric disk 30 by means of adhesive layer 39, whereby the two dielectric disks substantially constitute one body. Preferably, adhesive layer 39 is formed of an inorganic adhesive which does not adversely affect the high-frequency transmission mode. In the case where the waveguide is made to undergo a mode wherein no electric field is generated in the center of the waveguide (this mode will be mentioned later), small projection 38 is metalized and is then adhered by brazing. The regions around the two dielectric disks are enclosed by ring cover 40 formed of an insulating material. As is shown in FIGS. 2 and 3, cover 40 has coolant-introducing port 41 and coolant-discharging port 42. Through these ports, a coolant is made to flow, in the manner indicated by arrow C in FIGS. 2 and 3, in the space between the facing surfaces of dielectric disks 30 and 31 spaced from each other with gap g.

Figure 4:
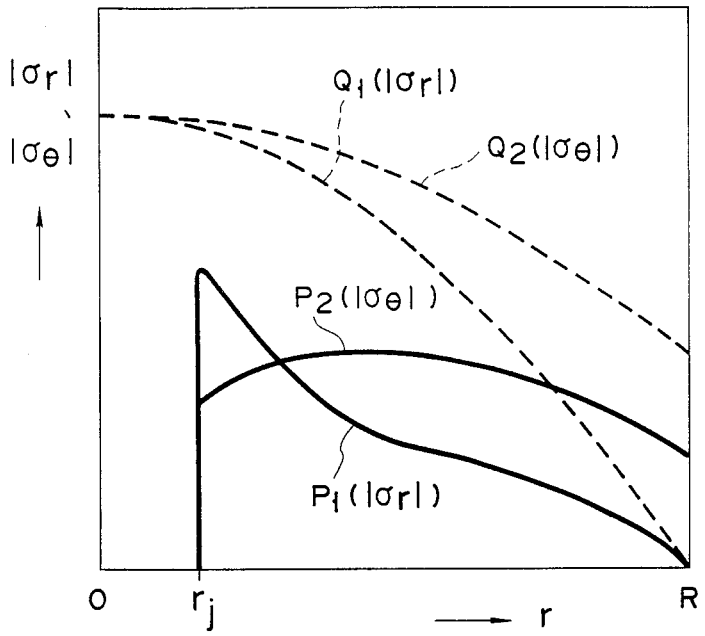
FIG. 4 is a graph showing the stress distribution of the dielectric disks shown in FIGS. 1 through 3.

FIG. 4 is a graph showing the stress distribution caused by the pressure difference between two dielectric disks which are arranged close to each other with a predetermined gap maintained. In FIG. 4, the axis of abscissa represents radial-direction point located between the center (O) of a dielectric disk and the circumference (R) thereof, and the axis of ordinate represents the absolute value of the radial component of stress (e.g., $|\sigma\gamma|$ and also the absolute value of the circumferential-direction component thereof (i.g., $|\sigma\gamma|$). In the conventional double disk window assembly, wherein two dielectric disks are merely arranged close to each other, the stress applied to the disks distributes in the manner indicated by curves Q1 and Q2 in FIG. 4. In contrast, in the present invention, wherein the two dielectric disks are coupled to each other in their centers, the stress applied to the disks distributes in the manner indicated by curves P1 and P2 in FIG. 4. As can be understood from the graph in FIG. 4, in the present invention, the stress applied to the dielectric circular disks is zero in the central coupling region (rj) and is relatively small from the end of the central coupling region to the circumference of the dielectric disks. Therefore, the dielectric disks employed in the present invention can resist a large pressure difference. Because of this advantage, the present invention can employ thin dielectric disks, resulting in an improvement in the heat radiating characteristics.

In the case of a gyrotron for obtaining transmission waves of a TEmn whispering-gallery mode ($m>n$, e.g., $m=12$ and $n=2$), wherein the oscillating frequency is in the band of 120 GHz, the continuous wave output power is 1 MW, and high-frequency electric fields are concentrated in the peripheral regions, the specifications were determined by example as follows. The two dielectric disks, formed of sapphire and having a thickness t of 2.0 mm, were spaced from each other by a gap g of 1.6 mm. The inner diameter D of the waveguide segment was 10 cm. Central small projection 28 has a diameter of 20 mm. The coolant, having a pressure of about 3 to 5 kg/cm$^2$, was made to flow at a flow rate of 4 to 8 m/sec.

Figure 5:
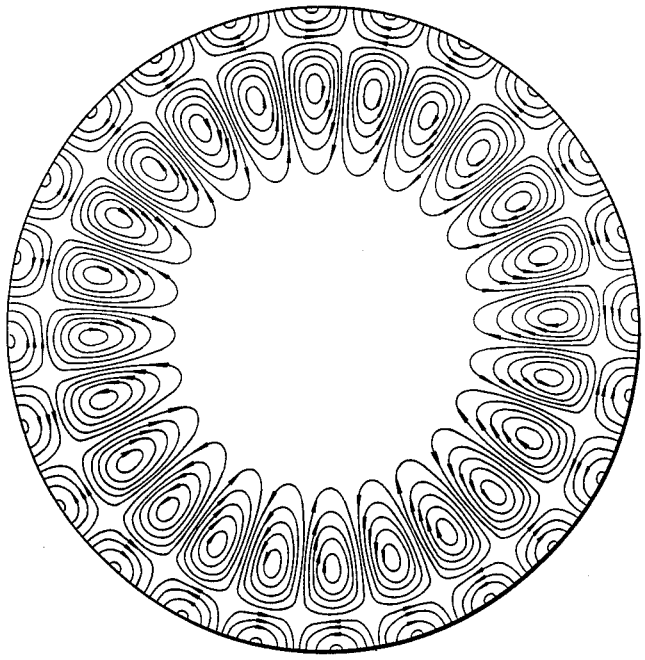
FIGS. 5 and 6 are field patterns illustrating a specific high-frequency mode, whispering-gallery mode and output power distribution adapted to the double faced disk cooled window of the invention.
Figure 6:
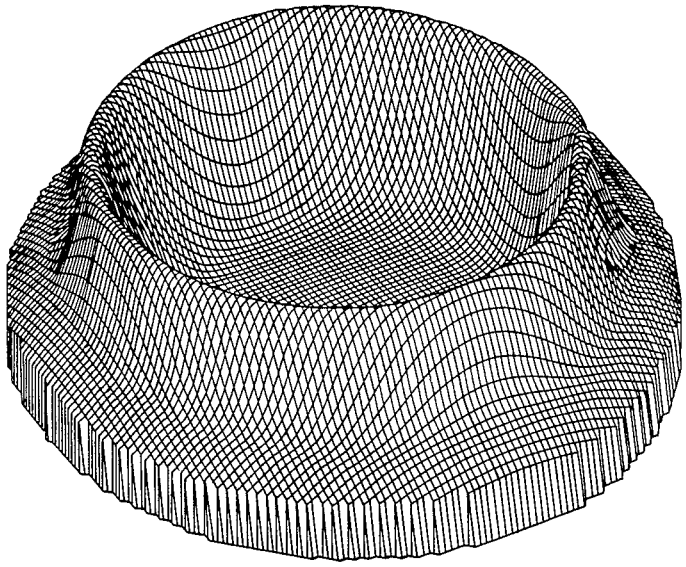

In a high-frequency mode wherein waves in the waveguide are transmitted through the air-tight disk window of the dielectric disks, an electric field pattern such as that shown in FIG. 5 was generated. The output power distribution of this electric field pattern is shown in FIG. 6. As can be understood from FIGS. 5 and 6, in the case of the whispering-gallery mode, no electric field was generated in the central portion of the waveguide. In consideration of this point, a pair of the two dielectric disks are coupled together by providing small projection 38 in the center of the waveguide, i.e., in the region where no electric field is generated. The coupling between the dielectric disks does not adversely affect the transmission mode. In addition, the mechanical strength of the double disk window assembly is improved as a result of the coupling between the two disks. Since the double disk window assembly has sufficient resistance against the atmospheric pressure and the stress which may be applied by the coolant, reliable operation is ensured in the case of the present invention.

Figure 7:
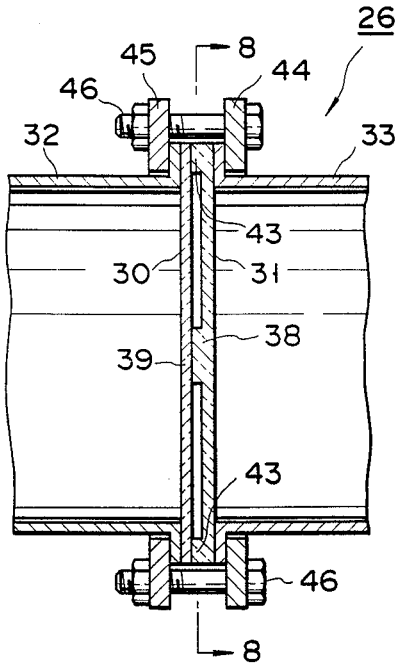
FIG. 7 is a longitudinal sectional view showing the main part of a double disk window assembly according to another embodiment of the present invention.
Figure 8:
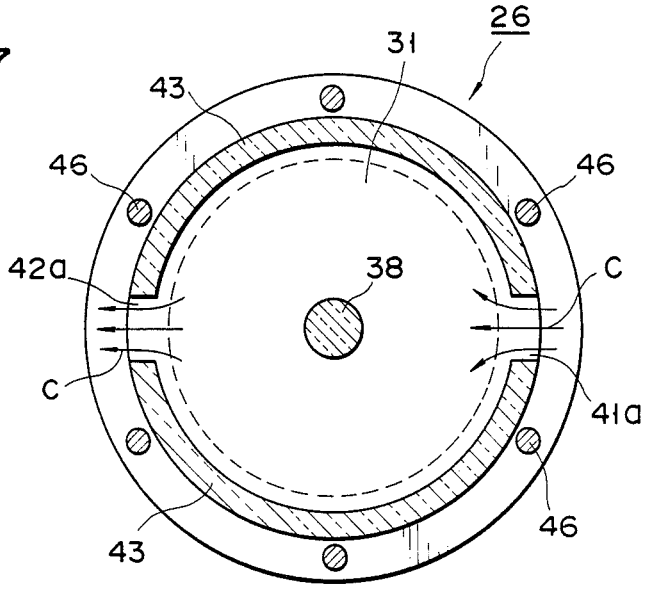
FIG. 8 is a sectional view taken along line 8—8 in FIG. 7.

FIGS. 7 and 8 illustrate a double disk window assembly according to the second embodiment of the present invention. In this disk window assembly, small projection 38 and gap-maintaining arcuate projections 43 are formed in the center and along the peripheries, respectively, of one side of dielectric disk 31. Small projection 38 and arcuate projections 43 are integral with disk 31 and have the same height corresponding to gap g between the two disks. Small projection 38 is coupled to dielectric disk 30, and arcuate projections 43 are in tight contact with disk 30. In the double disk window assembly, the two waveguide segments are coupled together by means of a pair of securing flanges 44 and 45 and a plurality of tightening bolt nuts 46. As is shown in FIG. 8, coolant-introducing port 41*a* and coolant-discharging port 41*b* are defined between arcuate projections 43.

In the case of the double disk window assembly shown in FIG. 7 and 8, the dielectric disks are in contact with each other not only in their central portions but also along the peripheral portions. Therefore, the gap between the two disks can be maintained more accurately than in the first embodiment. Even when the waveguide segments are fixed together by a very strong tightening force, the resultant stress does not act in the microwave transmission regions of the dielectric disks. Therefore, a highly-reliable waveguide can be obtained.

Figure 9:
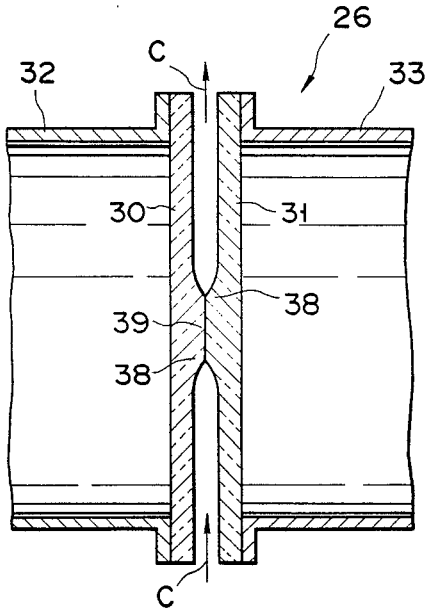
FIGS. 9 and 10 are longitudinal sectional views showing double faced disk cooled window assemblies according to other embodiments of the present invention.

FIG. 9 shows a double disk window assembly according to the third embodiment of the present invention. In this disk window assembly, each of two dielectric disks 30 and 31 has central projection 38 which projects with a gentle slope. Dielectric disks 30 and 31 are coupled together at projection 38. Since the two dielectric disks of this disk window assembly have the same shape, the manufacturing cost of the disk window assembly can be reduced. In addition, due to the gentle slopes of projection 30, stress is not applied to the disks in a concentrated manner.

Figure 10:
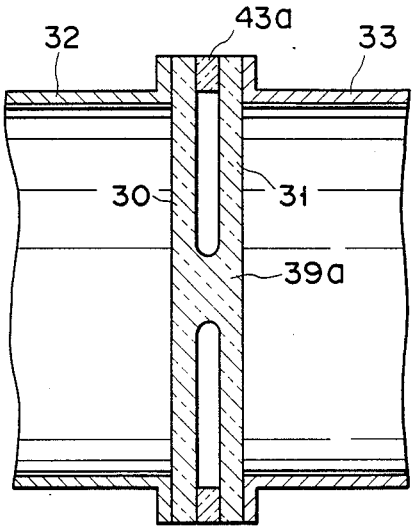

FIG. 10 shows a double disk window assembly according to the fourth embodiment of the present invention. The disk window assembly of this embodiment is not fabricated by assembling a pair of independent dielectric disks; it has a dielectric disk window structure formed by a single unit. More specifically, a single dielectric circular block is prepared, and is cut out from the outer circumference thereof in a manner that its radially central portion remains as central coupling portion 39*a* of the resultant double disk window assembly. When circular waveguide segments 32 and 33 are coupled together, ring-shaped spacer 43*a* formed of ceramic is inserted between dielectric disks 30 and 31. The double disk window assembly of this embodiment is somewhat troublesome to manufacture since a cutting step is involved in the manufacturing process. However, since an adhesive need not be used for the coupling between the two dielectric disks, it is possible to obtain a waveguide satisfactory in both the microwave transmission characteristics and the mechanical strength.

Figure 11:
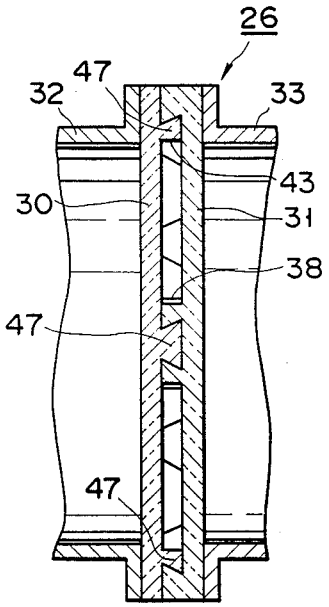
FIG. 11 is a longitudinal sectional view showing a double disk window assembly according to still another embodiment of the present invention.
Figure 12:
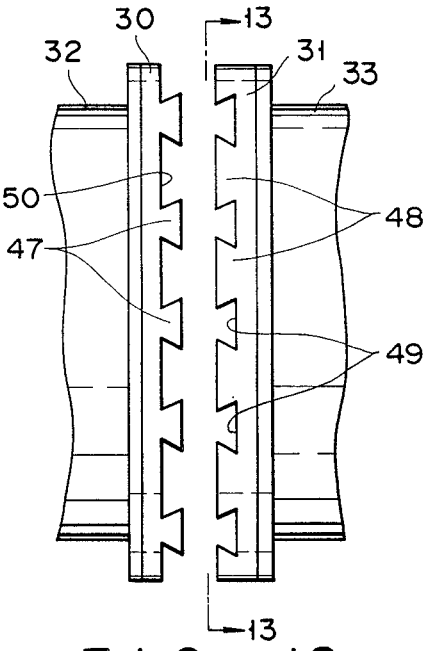
FIG. 12 is a side view showing the double disk window assembly shown in FIG. 11 looks like before fabrication.
Figure 13:
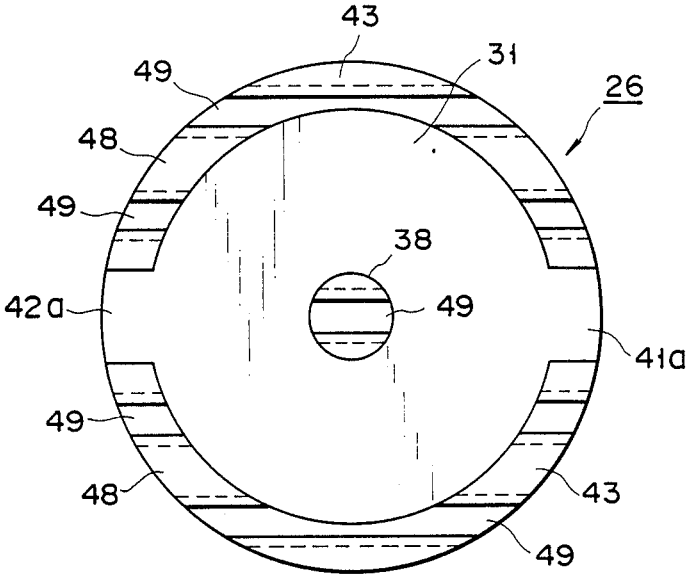
FIG. 13 is a front view taken along line 13—13 in FIG. 12.

FIGS. 11 through 13 show a double disk window assembly according to The fifth embodiment of the present invention. In the disk window assembly of this embodiment, two dielectric disks 30 and 31 are coupled together by mechanical fitting. More specifically, one dielectric disk 31 has reversely-tapered projections 48 and grooves 49 defined between the projections, while the other dielectric disk 30 has reversely-tapered projections 47 and grooves 50 defined between the projections. The size and shape of the projections and grooves are determined such that projections 48 can be fitted in grooves 50 and projections 47 can be fitted in grooves 49. Since these projections and grooves are parallel to one another, the two dielectric disks can be coupled by sliding them with reference to each other. The dielectric disks of this embodiment are somewhat troublesome to prepare, but since they can be coupled together by sliding, it is comparatively easy to fabricate a double disk window assembly. If necessary, the double disk window assembly can be easily disassembled back into the two dielectric disks.

Figure 14:
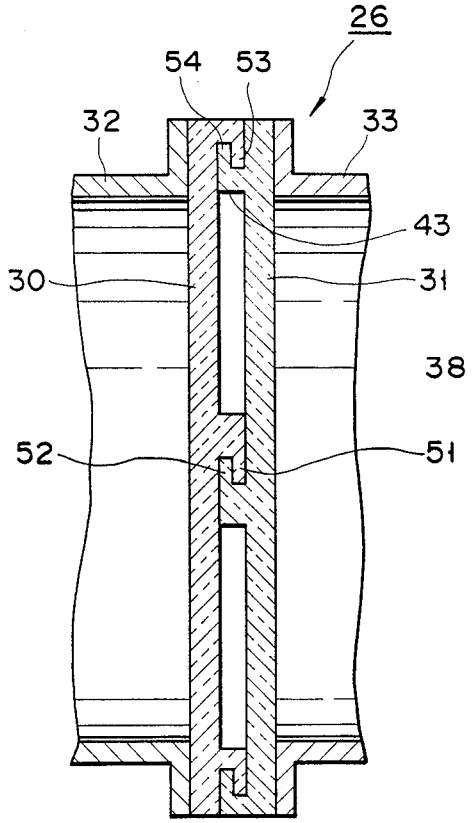
FIGS. 14 and 15 are longitudinal sectional views showing double disk window assemblies according to still other embodiments of the present invention.
Figure 15:
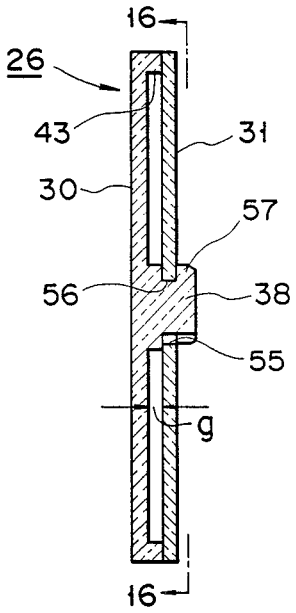
Figure 16:
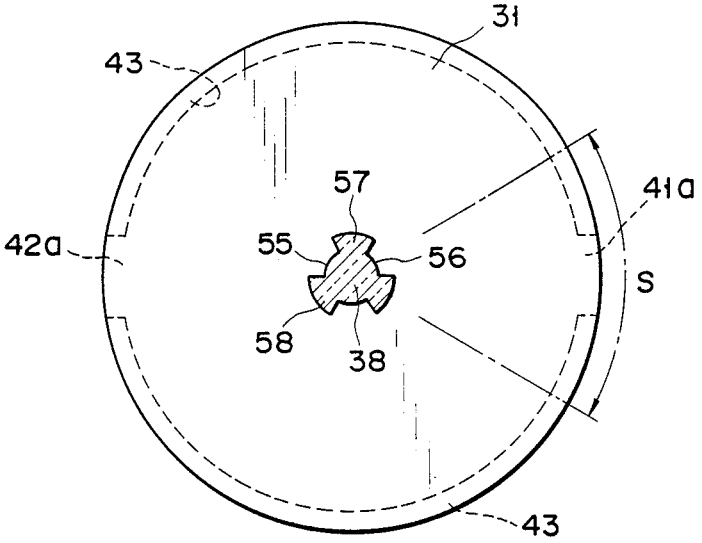
FIG. 16 is a sectional view taken along line 16—16 in FIG. 15.

FIG. 14 shows a double disk window assembly according to the sixth embodiment of the present invention. In this disk window assembly, dielectric disk 30 has central hook portion 51 and peripheral hook portion 53, and likewise, dielectric disk 31 has central hook portion 52 and peripheral hook portion 54. Central hook portions 51 and 52 can engage with each other, and jointly constitute central projection 38 in the engagement condition. Peripheral hook portions 53 and 54 can also engage with each other, and jointly constitute peripheral projection 43 in the engagement condition. Dielectric disks 30 and 31 can be easily coupled together by sliding hook portions 51, 52, 53 and 54 in a direction perpendicular to the drawing sheet of FIG. 14. FIGS. 15 and 16 show a double disk window assembly according to the seventh embodiment of the present invention. In the disk window assembly of this embodiment, dielectric disk 30 includes both central and peripheral projections 38 and 43, both of which are integral with disk 30. Dielectric disk 31 has through-hole 55 in the center thereof. Dielectric disks 30 and 31 are coupled together by engaging central projection 38 with hole 55. More specifically, central projection 38 of dielectric disk 30 is projected from dielectric disk 31, and has annular groove 56 into which dielectric disk 31 is fitted. At the tip end, central projection 38 has three fan-shaped portions 57 extending in three radial directions of dielectric disk 30. To couple dielectric disks 30 and 31 together, the hole-defining portion of dielectric disk 31 is inserted into annular groove 56 of central projection 38 of dielectric disk 30, and is then rotated 60 until it abuts fan-shaped portions 57, as is indicated by reference symbol S in FIG. 16. In this fashion, dielectric disks 30 and 31 are coupled together, with gap g maintained therebetween. It should be noted that the double disk window assembly of the seventh embodiment is easy both to assemble and to disassemble. In the double disk window assembly of the seventh embodiment, a complete seal is not provided between central projection 38 of disk 30 and the hole-defining portion of disk 31. Therefore a circular waveguide segment (not shown) which is to be connected to dielectric disk 31 is operated under an environment that does not require a vacuum seal.

The above-mentioned embodiments were described, referring to the case where the number of dielectric disks is two. However, the present invention is not limited to this, and can be applied to a waveguide employing three or more dielectric disks. Briefly speaking, the present invention is applicable to a waveguide wherein a coolant is make to pass in the gap between the adjacent ones of three or more dielectric disks.

As mentioned above, according to the present invention, the gap between the dielectric disks can be maintained at a predetermined value even if stress arising from the coolant or external pressure is applied to the dielectric disks. Therefore, desirable microwave transmission characteristics can be maintained, and the dielectric disks are prevented from cracking or being broken. In addition, the coolant can flow along the entire surface of the dielectric disks, so that the dielectric disks can be cooled efficiently. Therefore, the present invention is suitable for use in a microwave transmitting apparatus operated in a whispering-gallery waveguide mode, for instance, wherein a high-frequency component of an electromagnetic field does not exist or little exists in the central portion of a circular waveguide.

What is claimed is:

1. A double disk window which is to be cooled with a waveguide coolant and is used in a waveguide having first and second waveguide segments, said double disk window assembly comprising:

a first dielectric disk which is formed of a dielectric material of a type permitting a microwave to pass therethrough and is coupled air-tightly to the first waveguide segment, the microwave having a predetermined electric field pattern across the waveguide segment with an intensity which is concentrated in its peripheral regions and smaller in a central region; and a second dielectric disk which is formed of a dielectric material of a type permitting the microwave to pass therethrough, and is located in a manner to face the first dielectric disk with a predetermined gap through which the coolant passes, and coupled air-tightly to the second waveguide segment, and which includes a first central coupling section, which is located in the central region of the electric field pattern, for mechanically coupling the second dielectric disk to the first dielectric disk.

2. A double disk window assembly according to claim 1, further comprising:

sealing means for providing a seal between the first and second dielectric disks, to thereby define a coolant-flowing path, said sealing means including a coolant-introducing port and a coolant-discharging port.

3. A double disk window assembly according to claim 1, wherein said first dielectric disk includes, in said central region thereof, a second central coupling section which is coupled to the first central coupling section of the second dielectric disk.

4. A double disk window assembly according to claim 3, wherein said first and second central coupling sections engage with each other.

5. A double disk window according to claim 1, further comprising:

a port for introducing the coolant into an inner space between the first and second dielectric disks, the coolant flowing around the coupling section to cool the double disk window assembly; and an another port for discharging the coolant from the inner space.

6. A double disk window which is to be cooled with a waveguide coolant and is used in a waveguide having first and second waveguide segments, said double disk window assembly comprising:

a first dielectric disk which is formed of a dielectric material permitting a microwave to pass therethrough and is coupled air-tightly to the first waveguide segment; and a second dielectric disk which is formed of a dielectric material permitting the microwave to pass therethrough, and located in a manner to face the first dielectric disk with a predetermined gap through which the coolant passes, and coupled air-tightly to the second waveguide segment, and includes a first central coupling section for mechanically coupling the second dielectric disk to the first dielectric disk, wherein at least one of said first and second dielectric disks includes, in a periphery thereof, a peripheral coupling section for mechanically coupling the first and second dielectric disks together.

7. A double disk window which is to be cooled with a waveguide coolant and is used in a waveguide having first and second waveguide segments, said double disk window assembly comprising:

a first dielectric disk which is formed of a dielectric material permitting a microwave to pass therethrough and is coupled air-tightly to the first waveguide segment; and a second dielectric disk which is formed of a dielectric material permitting the microwave to pass therethrough, and located in a manner to face the first dielectric disk with a predetermined gap through which the coolant passes, and coupled air-tightly to the second waveguide segment, and includes a first central coupling section for mechanically coupling the second dielectric disk to the first dielectric disk, wherein said first central coupling section of the second dielectric disk is bonded to the first dielectric disk by use of an adhesive having no adverse effects on a high-frequency transmission mode.

8. A double disk window assembly according to claim 7, wherein said coupling sections have brazed surfaces.

9. A double disk window which is to be cooled with a waveguide coolant and is used in a waveguide having first and second waveguide segments, said double disk window assembly comprising:

a first dielectric disk which is formed of a dielectric material permitting a microwave to pass therethrough and is coupled air-tightly to the first waveguide segment; and a second dielectric disk which is formed of a dielectric material permitting the microwave to pass therethrough, and located in a manner to face the first dielectric disk with a predetermined gap through which the coolant passes, and coupled air-tightly to the second waveguide segment, and includes a first central coupling section for mechanically coupling the second dielectric disk to the first dielectric disk, wherein said first and second dielectric disks and said coupling section are integrally formed as one body.

10. A double disk window assembly which is to be cooled with a waveguide coolant and is used in a waveguide having first and second waveguide segments, said double disk window assembly comprising:

a first dielectric disk section which is formed of a dielectric material of a type permitting a microwave to pass therethrough and is coupled air-tightly to the first waveguide segment, the microwave having an electric field pattern across the waveguide segment having an intensity which is concentrated in its peripheral regions and smaller in a central region; and a second dielectric disk section which is formed of a dielectric material permitting the microwave to pass therethrough, and located in a manner to face the first dielectric disk section with a predetermined gap through which the coolant passes, said second dielectric disk section coupled air-tightly to the second waveguide segment, and includes a first central coupling section, which is located in the central region of the electric field pattern, for coupling the second dielectric disk section to the first dielectric disk section to form a unit structure.

11. A double disk window assembly according to claim 10, further comprising:

a port for introducing the coolant into an inner space between the first and second dielectric disks, the coolant flowing around the coupling section to cool the double disk window assembly; and an another port for discharging the coolant from the inner space.

* * * * *